US007329172B2

(12) United States Patent
Dieck et al.

(10) Patent No.: US 7,329,172 B2
(45) Date of Patent: Feb. 12, 2008

(54) ROTARY MOWER BLADE SHARPENER HAVING MOVABLE GRIDING WHEELS

(75) Inventors: James H. Dieck, Riverfalls, WI (US); Gregory A. Veenendall, Riverfalls, WI (US)

(73) Assignee: Foley-Belsaw Company, Minneapolis, MN (US)

( * ) Notice: Subject to any disclaimer, the term of this patent is extended or adjusted under 35 U.S.C. 154(b) by 0 days.

(21) Appl. No.: 11/671,935

(22) Filed: Feb. 6, 2007

(65) Prior Publication Data

US 2007/0184756 A1 Aug. 9, 2007

Related U.S. Application Data

(60) Provisional application No. 60/771,242, filed on Feb. 8, 2006.

(51) Int. Cl.
*B24B 1/00* (2006.01)

(52) U.S. Cl. ..... 451/45; 451/196; 451/224; 451/371

(58) Field of Classification Search ..... 451/45, 451/192, 193, 196, 198, 202, 203, 205, 206, 451/208, 224, 229
See application file for complete search history.

(56) References Cited

U.S. PATENT DOCUMENTS

| | | | |
|---|---|---|---|
| 805,127 | A | 11/1905 | Fetters |
| 2,180,911 | A | 11/1939 | Rodgers |
| 2,279,798 | A | 4/1942 | Shelburne |
| 2,314,945 | A | 3/1943 | Maynard et al. |
| 2,572,530 | A | 10/1951 | Smith |
| 2,780,034 | A | 2/1957 | Turner |
| 2,793,474 | A | 5/1957 | Smith |
| 3,590,533 | A * | 7/1971 | Samson et al. ..... 451/146 |
| 3,724,139 | A | 4/1973 | Leverenz |

(Continued)

OTHER PUBLICATIONS

"Neary Spin-Matic II" Brochure, Neary Manufacturing, copyright 1986.

(Continued)

*Primary Examiner*—Dung Van Nguyen
(74) *Attorney, Agent, or Firm*—Stuart R. Hemphill

(57) ABSTRACT

A device and method for sharpening a mower blade are provided, in which a mounting device for mounting a rotary blade having two opposite cutting edges to be sharpened, wherein the mounting device is capable of positioning the blade in a first fixed state and a second, axially pivoting state. One or more grinding head assemblies are each positioned on an opposite end of the blade, wherein the grinding head assemblies respectively grind the two opposite cutting edges to be sharpened. A control system controls movement of the two grinding head assemblies. The mounting device positions the blade in the first fixed state to enable the two grinding head assemblies to grind the cutting edges in a direction substantially parallel to the cutting edges of the blade to perform a straight grind, and then may position the blade in the second axially pivoting state to enable the blade to pivot around its blade rotation axis away from the grinding head assemblies upon completion of the straight grind, thereby forming a curve at the end of each cutting edge. The mounting assembly also holds the blade in a third, freely rotating state in which the blade may substantially freely rotate around its blade rotation axis to enable balancing of the blade after sharpening.

24 Claims, 10 Drawing Sheets

U.S. PATENT DOCUMENTS

| | | | | |
|---|---|---|---|---|
| 4,005,554 | A | 2/1977 | Campbell | |
| D250,196 | S | 11/1978 | Caccioli et al. | |
| 4,148,158 | A | 4/1979 | Hewitt | |
| 4,192,103 | A | 3/1980 | Sousek | |
| 4,621,456 | A | 11/1986 | Winstanley | |
| 4,694,613 | A | 9/1987 | Bernhard | |
| 4,736,544 | A * | 4/1988 | Greenquist | 451/124 |
| 4,741,130 | A | 5/1988 | Tano et al. | |
| 4,936,053 | A * | 6/1990 | Shanelec | 451/224 |
| 4,993,199 | A | 2/1991 | Hughes | |
| 5,012,617 | A | 5/1991 | Winstanley | |
| D320,607 | S | 10/1991 | Smith et al. | |
| 5,218,787 | A * | 6/1993 | Rice | 451/229 |
| 5,291,724 | A | 3/1994 | Cotton | |
| 5,321,912 | A | 6/1994 | Neary et al. | |
| 5,333,112 | A | 7/1994 | Bybee | |
| 5,549,508 | A | 8/1996 | Searle et al. | |
| 5,558,560 | A | 9/1996 | Uchida | |
| 5,601,473 | A | 2/1997 | Strain et al. | |
| D386,504 | S | 11/1997 | Dieck | |
| 5,879,224 | A | 3/1999 | Pilger | |
| 6,010,394 | A | 1/2000 | Dieck et al. | |
| 6,290,581 | B1 | 9/2001 | Dieck et al. | |
| 6,368,196 | B1 * | 4/2002 | Bauer | 451/293 |
| 6,471,569 | B1 * | 10/2002 | Bernhard | 451/224 |
| 6,685,544 | B1 | 2/2004 | Dieck et al. | |
| 6,699,103 | B1 | 3/2004 | Dieck et al. | |

OTHER PUBLICATIONS

"Ransomes Precision Grinders" brochure, Ransomes America Corporation, copyright 1994.

* cited by examiner

ROTARY MOWER BLADE SHARPENER HAVING MOVABLE GRIDING WHEELS

RELATED APPLICATIONS

This application claims priority to U.S. Provisional Application Ser. No. 60/771,242, filed Feb. 8, 2006, entitled "Rotary Mower Blade Sharpener Having Movable Grinding Wheels," which is incorporated herein by reference in its entirety.

BACKGROUND OF THE INVENTION

Rotary mowers operate by having a generally planar blade that rotates around its midpoint (a blade rotation axis perpendicular to the blade plane) in a plane substantially parallel to the ground over which the mower runs. The blade typically has two cutting edges, one on each of opposed sides of the blade's longitudinal axis. One cutting edge extends from one distal end of the blade toward the midpoint of the blade along one edge of the blade, and the other cutting edge extends from the opposite distal end of the blade toward the midpoint of the blade along the opposite edge of the blade from the first cutting edge. The cutting edges must be sharpened periodically to provide desired mowing capabilities, including a clean cut, which may affect grass look and health. Given their high rotational speeds, the blades must also be properly balanced.

Known devices for sharpening the edges of such mowing blades may employ one or more grinding wheels provided in a fixed position against which the edges of the blade to be sharpened are moved in order to grind the cutting edges to the desired sharpness. Such sharpening devices may use a flat grinding wheel that performs the grinding operation using the outer circumference of the grinding wheel, i.e., a surface parallel to the wheel's axis of rotation. An example of such a known sharpening device is described in U.S. Pat. No. 6,471,569.

Such sharpening devices have a number of drawbacks. For example, such devices may require that the grinding wheel(s) be adjusted on two planes in order to achieve the correct grind angle. This angle can change, for example, due to rotary blade width changes or grinding wheel wear, and therefore may require additional adjustments for each blade to be sharpened to maintain the correct grind angle. Those adjustments slow sharpener throughput when large numbers of blades need sharpening.

Also, once the grinding has been performed, the blade must be removed from the device and checked for balance, which can be affected by the grinding process. If the blade is not in balance, the blade must be reinserted into the sharpening device and re-sharpened so as to remedy imbalance, then again removed and rechecked for balance. This process is repeated until the blade is balanced. Again, this slows sharpener throughput.

In view of these and other drawbacks of the known sharpening devices, there is a need for an improved device and method for sharpening rotary mower blades.

SUMMARY OF THE INVENTION

The present invention provides an improved mower blade sharpening apparatus and method in which a blade to be sharpened is positioned in a fixed state, and one or more movable grinding wheels are provided. When two grinding wheels are provided, each of the grinding wheels moves along one of the two cutting edges of the blade to be sharpened, and preferably both wheels move simultaneously toward the center of the blade to be sharpened. Thus, both cutting edges of the blade are sharpened simultaneously using a straight grinding path in which the grinding wheels are positioned at a selected angle with respect to the blade surface to be sharpened. The apparatus also provides a free pivoting state for testing and correcting balance of the blade being sharpened without removing the blade from the sharpening device.

In one embodiment, the apparatus also may have a tilting state used during sharpening in coordination with the fixed state. In the tilting state, as a grinding wheel advances toward the center of the blade and reaches the inner end of the cutting edge to be sharpened, a cam system enables the blade to perform a tilting motion, such that the blade pivots away from the grinding wheel at the end of the straight grind to form a large blend or relief radius. The tilting motion produced by a cam system at the end of the grinding head path creates a stress relieving radius at the inner end of the sharpened cutting edge. Alternatively, the grinding wheel can be controllably backed away from the surface to be sharpened to form this radius.

These and other features and advantages of the present invention will become apparent to those skilled in the art from the following detailed description, which shows and describes illustrative embodiments of the invention, including best modes contemplated for carrying out the invention. As it will be realized, the invention is capable of modifications in various aspects, all without departing from the spirit and scope of the present invention. Accordingly, the drawings and detailed description are to be regarded as illustrative in nature and not restrictive.

BRIEF DESCRIPTION OF THE DRAWINGS

FIG. 3A is without the blade present and with the blade support assembly not tilted, while FIG. 3B shows the blade mounted for sharpening and tilted for relief grinding.

DETAILED DESCRIPTION

The sharpener will now be described in further detail with reference to the accompanying drawings.

Figure 1:
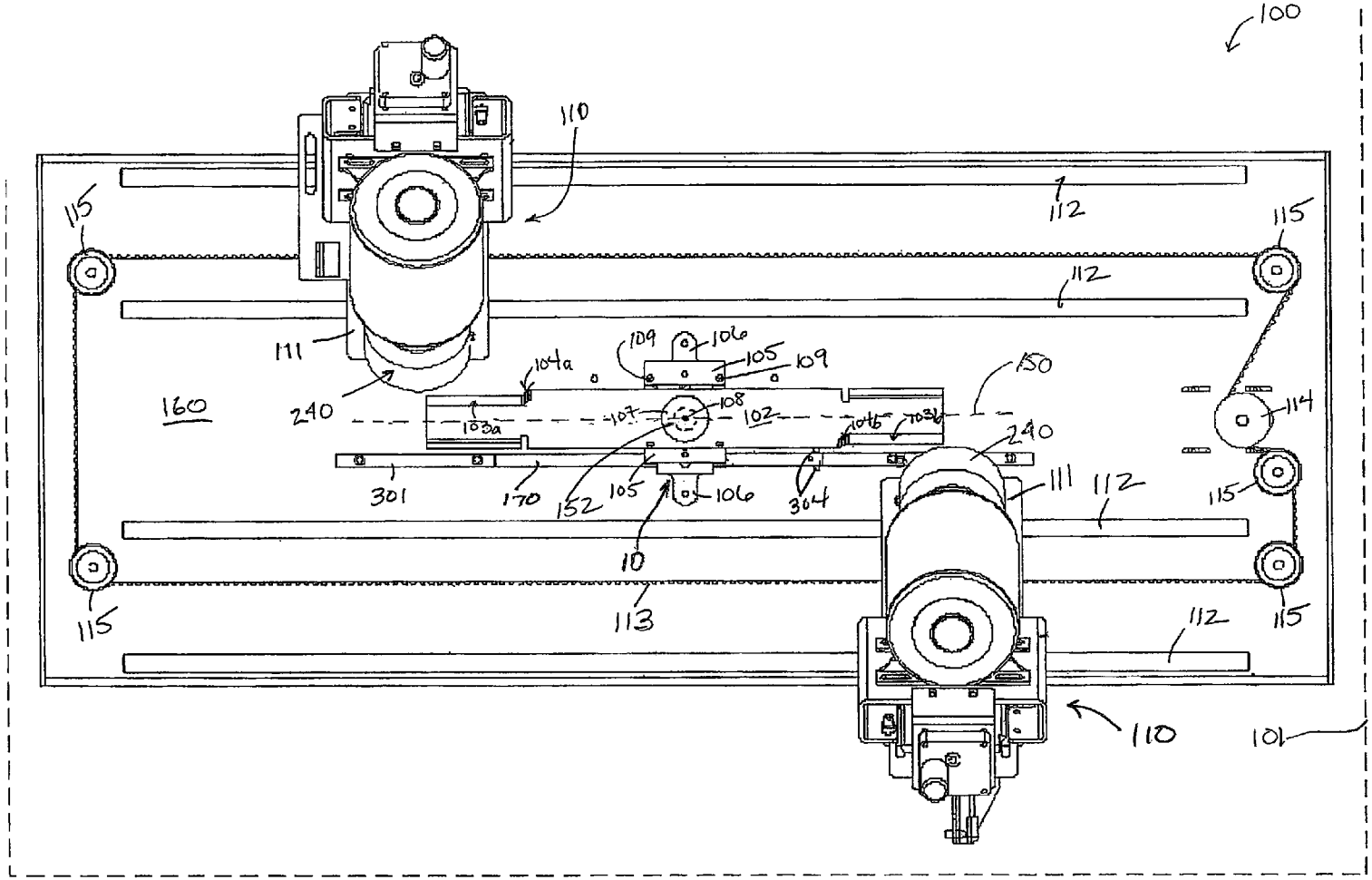
FIG. 1 provides a front view of a sharpening apparatus in accordance with the present invention.
Figure 5:
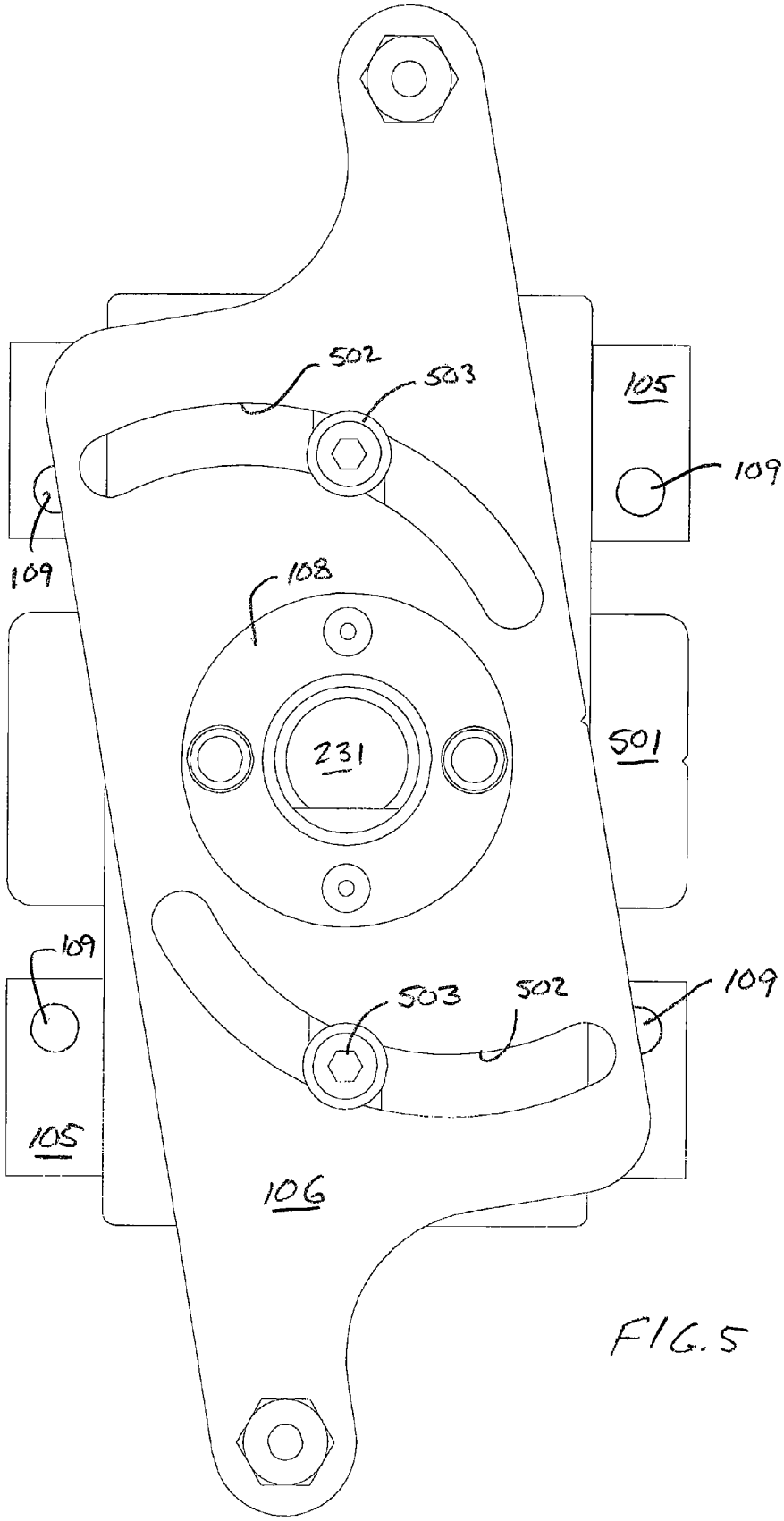
FIG. 5 provides a rear view of a center support assembly for mounting a blade in a sharpening apparatus in accordance with the present invention.

Overall Assembly. FIG. 1 provides a diagram of a sharpening device 100 in accordance with one embodiment of the present design. A mower or other rotary blade 102 to be sharpened has substantially straight cutting edges 103*a*,

103*b* on opposite ends and opposed sides of the blade 102. Straight cutting edges 103*a*, 103*b* may be substantially parallel with the longitudinal axis 150 of blade 102 or may be angled in relation to the longitudinal axis of blade 102. Cutting edges 103*a*, 103*b* may have an innermost portion 104*a*, 104*b* that is a curved, strain relief portion of the blade 102 that is desirable to reduce stress on the cutting edges when used in mowing or other cutting operations. The blade 102 is positioned in the sharpening device 100, which may be enclosed by a cabinet (indicated at 101) with a generally vertical main base 160. The blade 102 is attached to the sharpening device by a center support assembly 10 that includes adjustable blade engaging assemblies (e.g., movable blade clamping blocks) 105 that may be positioned by rotating a cam plate clamp 106 to tighten support dowels 109 carried on blade clamping blocks 105 against the opposed sides of the blade 102 near its center hole 152 (in phantom). Additional details of the cam lever 106 and clamping blocks 105 are illustrated in FIG. 5 and discussed below.

Figure 2:
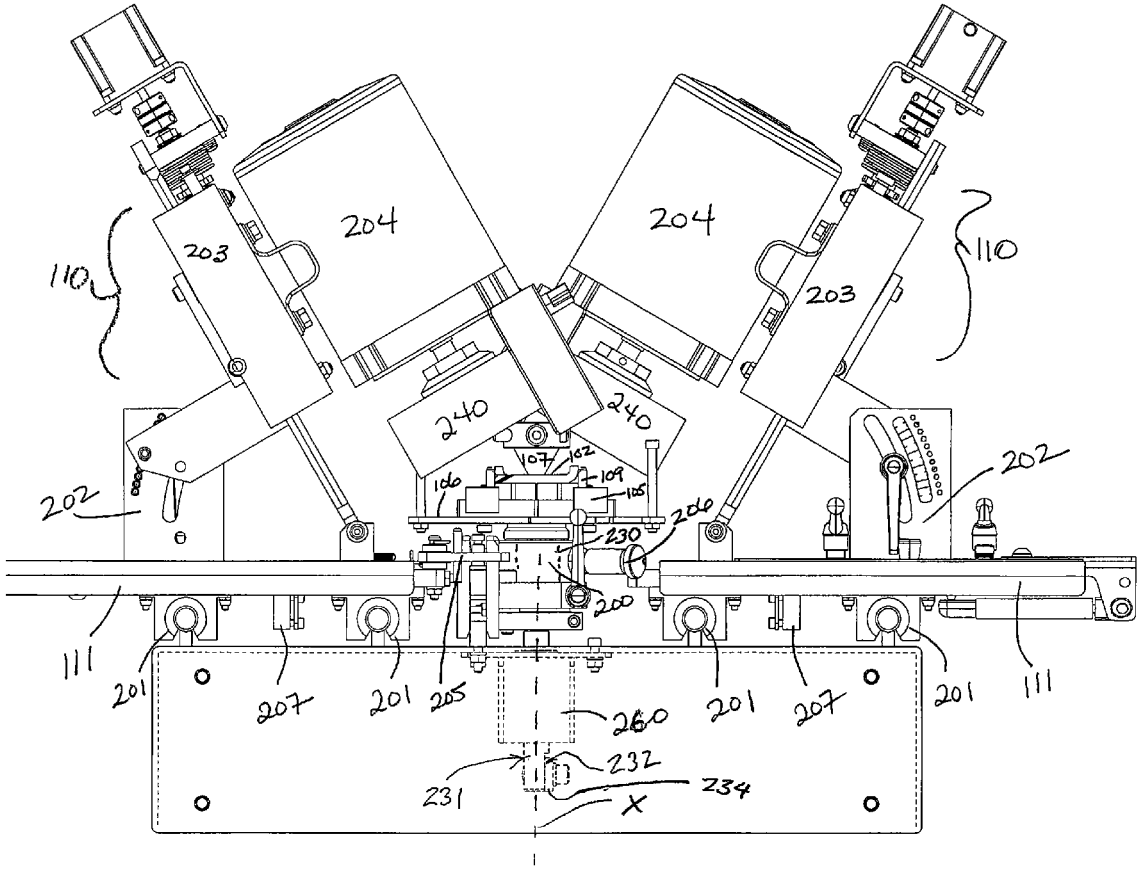
FIG. 2 provides a side view of the sharpening apparatus shown in FIG. 1, with the main base and drive components removed.

The blade 102 is placed with its center hole 152 surrounding a central threaded shaft assembly 108 and fastened to the shaft assembly 108 by a centering cone 107 that screws onto the threaded shaft assembly 108 and fills the center hole 152. As seen in FIG. 2, the centering cone 107 is the outermost element of an assembly of components including balancer bearing assembly 230 and shaft assembly 108 aligned with and mounted to pivot shaft 231 and extending through the main base. As explained in greater detail below, locking pin 206 is used to separate a front half of the center support assembly 10, extending forward from the locking pin 206 to centering cone 107, from the components at the locking pin 206 and extending backward to the flattened end 232 of pivot shaft 231, together comprising a back half of the center support assembly 10. When locking pin 206 is in its release position, the front half of the center support assembly 10 is in a free pivoting or balancer state, pivoting readily on bearings within balancer bearing assembly 230 contained within housing 200. When the locking pin 206 is in its locked position, the front and back halves of the center support assembly 10 are locked together. This locked assembly may be either in the fixed state, or in one embodiment, in a tilting state, supported by bushings within bushing housing 260, based on the latched or released condition of a relief rotate bar 170, discussed next.

Below the threaded shaft 108 is a relief rotate bar 170 that extends laterally from either side of the blade engaging assemblies in a direction generally parallel to the longitudinal axis 150 of blade 102. As explained further below, latch/release 304 carried on the relief rotate bar 170 engages an anti-rotation bar 301 mounted to the main base 160 to hold the blade 102 fixed relative to the main base 160 during sharpening, until release is needed. It should be noted that the center support assembly 10 is mounted so that when it is released from engagement with anti-rotation bar 301 the assembly 10 and blade 102 can tilt about five to fifty degrees around a blade rotation axis X (see FIG. 2) aligned with pivot shaft 231 axis and shaft assembly 108. Such tilting motion is useful for a relief curve grind operation described in further detail below; but such tilting is undesirable for straight-line grinding, where stable holding of the blade 102 aids grinding accuracy.

First and second grinding head assemblies 110 are provided on first and second grinder wheel support carriages 111 that are movable within the cabinet 101 along traverse shafts 112 mounted in an upper pair and a lower pair on the main base 160. The support carriages 111 are coupled to a drive belt 113 that is controlled by belt drive pulley 114 and idler pulleys 115. By operation of the drive belt 113, the support carriages 111 may both be moved simultaneously and symmetrically along their respective pair of traverse shafts 112. Alternate means, such as a symmetrical screw drive system, may be provided to control the movement of the support carriages 111.

The longitudinal axis 150 of the rotary blade 102 to be sharpened is aligned, for example, to be parallel with the traverse shafts 112 or to be positioned at an angle commensurate with an angle defined by the cutting edges 103*a*, 103*b* relative to the longitudinal axis 150, thus enabling the moving grinding head assemblies 110 to sharpen the cutting edges 103*a*, 103*b* and, if desired, form the curved, strain relief portions 104*a*, 104*b* of the blade 102 and then, upon reversal of the drive belt 113, to retract away from the blade 102 after sharpening. The positioning of the rotary blade 102 is described in further detail below with references to FIG. 7.

Grinding Head Assemblies and Support Carriages. In the sharpening device and method shown, the grinding head assemblies 110 use cupped grinding wheels, for example, Type 6 straight cupped wheels as defined by ANSI B7.1-2000. Such straight, cupped grinding wheels 240 have an axis of rotation perpendicular to their grinding surfaces 190 (see FIG. 4) and the portion of the blade surface to be sharpened (see FIG. 4). The straight cupped grinding wheels hold a set angle with respect to the blade 102 (e.g., 30 degrees), regardless of blade width or wheel wear, allowing for efficient set-up and consistent sharpening angles. The sharpening angle of the grinding head assemblies 110 (i.e., the grinding surface 190 of a grinding wheel relative to the blade surface to be ground) is adjustable as needed, based upon the desired angle of the sharpened surfaces formed on the blade edges 103*a*, 103*b*.

Referring again to FIG. 2, FIG. 2 provides a side view of the sharpening device 100 of FIG. 1. In FIG. 2, the support carriages 111 and grinding head assemblies 110 have mounting linear bearings 201 that attach to the support carriages 111 and slide on the traverse shafts 112 (see FIG. 1). These mounting linear bearings 201 enable the support carriages 111 to traverse along the length of the traverse shafts 112. Thus, the traverse shafts 112 ensure linear motion of grinding wheels 240 along a grinding path generally parallel to the cutting edges 103*a* and 103*b* of the blade 102 and in grinding engagement with a cutting edge 103*a*, 103*b* of the blade. A belt clamp block 207 is also provided on each support carriage 111 to fixably connect the support carriage 111 to the drive belt 113 (not shown in FIG. 2), such that when the drive belt 113 moves in either direction, the support carriages 111 also move by sliding along the traverse shafts 112 on mounting linear bearings 201 in either direction along the traverse shafts 112. As seen in FIG. 1, when the drive belt 113 moves clockwise, each grinding head assembly 110 moves toward the center of the blade 102. Upon reversal, counterclockwise motion of the belt 113 causes each grinding head assembly to move away from the center of the blade 102. An alternate method of providing such balanced motion is a powered single screw thread with right and left hand threads on opposite ends (not shown). Driven by a motor, this screw system can drive each grinding head 110 toward and away from the center at exactly the same rate and position relative to the rotary blade midpoint.

Referring again to FIG. 2, each grinding head assembly 110 includes a cam slot-pin mechanism 202 for adjusting the angle of its grinding head assembly 110 with respect to the blade 102. In particular, the angle at which the grinding surface 190 attacks the plane of the blade 102 is adjusted. Each grinding head assembly 110 further includes an axial adjusting mechanism 203, such as a screw drive, that moves the grinding head assemblies 110 toward and away from the blade 102 along the axis of rotation of the grinding wheel 240. Each grinding head assembly 110 is individually controlled by its corresponding adjusting mechanism 203, such that one grinding head assembly 110 may be positioned in a grinding position contacting the blade 102 while the other grinding head assembly 110 may be withdrawn away from the blade 102. This independent positioning of the grinding head assemblies 110 is particularly useful during the balancing process following the sharpening process (described in further detail below). Each support carriage 111 further includes a motor 204 for driving the rotation of its grinding wheel 240.

Figure 8:
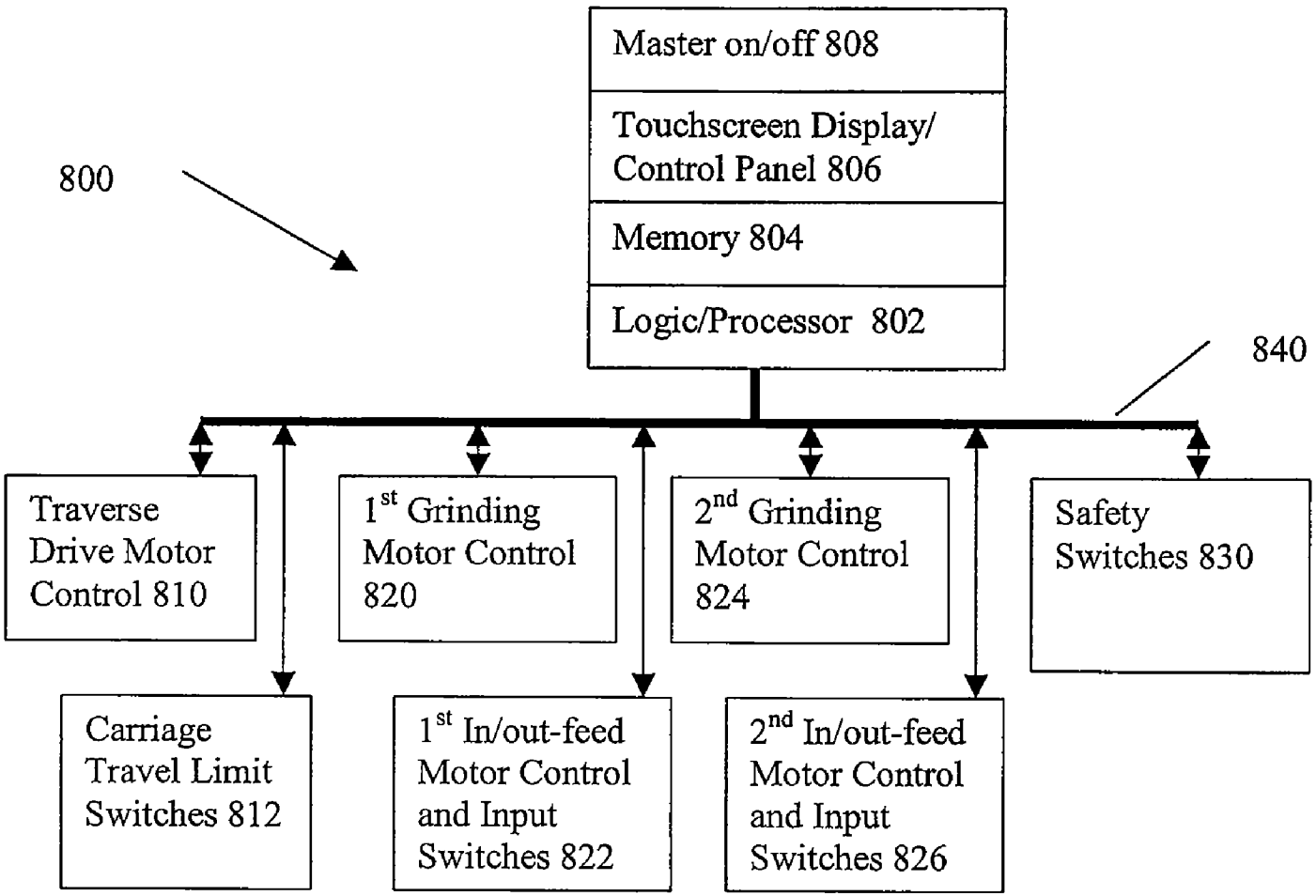
FIG. 8 is a schematic block diagram for a control system for the sharpening apparatus.

Control System. Control of the motion of the grinding head assemblies in a two grinding head system may be performed with a control system 800, as schematically shown in FIG. 8. The control system 800 includes electronic logic or a processor 802 with memory 804 to hold the control sequence and condition sensing instructions for control software, a touchscreen display 806 (which also may be a manual control panel with switches and a few status lights or a small display for alphanumeric information), and a master on/off control 808. Control system processor 802 is connected via a bus or other communication links 840 to the key components, including: a traverse drive motor control 810 and the associated carriage travel limit switches 812; first grinding motor control 820; first grinder in/out feed motor control and input switches 822; second grinding motor control 824; second grinder in/out feed motor control and input switches 826; and safety switches 830. The control software, executed by the processor 802, controls on/off status, direction and speed for the drive motor control 810 for traverse drive belt wheel 114 and also the grinder in/out feed motor controls 822, 826 that power axial actuators (infeed/outfeed) in adjusting mechanism(s) 203. The control software, executed by the processor 802, further controls on/off status of the first and second grinding motor controls 820, 824 that govern grinding head assembly motor(s) 204. The control software also communicates with limit switches 812 for sensing position of the carriages 111 and status of other moving parts (switches 822, 826 for infeed/outfeed adjusting mechanism(s) 203 and safety switches 830, that ensure selected components are in place before beginning sharpening).

The lines for various sensed positions and the motion-control signals can be implemented by suitable wiring or other communication connections and power can be delivered to the controlled components by power lines (such lines omitted for simplicity in FIGS. 1-7). The control system 800 thus permits the user to initiate grinding operations when the blade 102 is properly mounted and the sharpening angle is suitably adjusted and stop grinding when the desired grinding is complete. In one embodiment, the control system 800 controls coordinated movement of the two grinding head assemblies for each of two grinding states. In the fixed state, the control system 800 moves each grinding head assembly to grind in a path substantially parallel to each cutting edge 103*a* and 103*b* of the blade 102 while the blade 102 is held fixed, and, in the tilting state, the control system 800 moves each grinding head assembly while the center support assembly 10 enables the blade 102 to pivot in a limited arc around its blade rotation axis X, to tilt away from the grinding head assemblies 110 while a linear grind motion continues, thereby forming a relief radius or curve at the end of each cutting edge.

The touch-screen display 806 (or other control panel) of control system 800 provides an input device, allowing selective retraction and inhibiting motor action of one or the other of grinding assemblies 110 when grinding on only one end of blade 102 is desired to achieve balance. In this mode, the belt drive 113 still moves both carriages 111, but only one grinding surface 190 makes grinding contact to remove blade material.

Relief Radius Grinding. FIG. 2 also provides a side view of a cam plate 205 that is used to tilt the blade 102 during a relief radius-forming phase of sharpening. (This grind is optional, but helps relieve a possible stress point in the blade 102 when used.) A locking pin 206 combined with a balancer bearing assembly 230 used in the balancing process performed after sharpening is also shown. Locking pin 206 remains in its locking position during relief radius grinding. Both the sharpening process and the balancing process will be described in detail below.

Figure 3A:
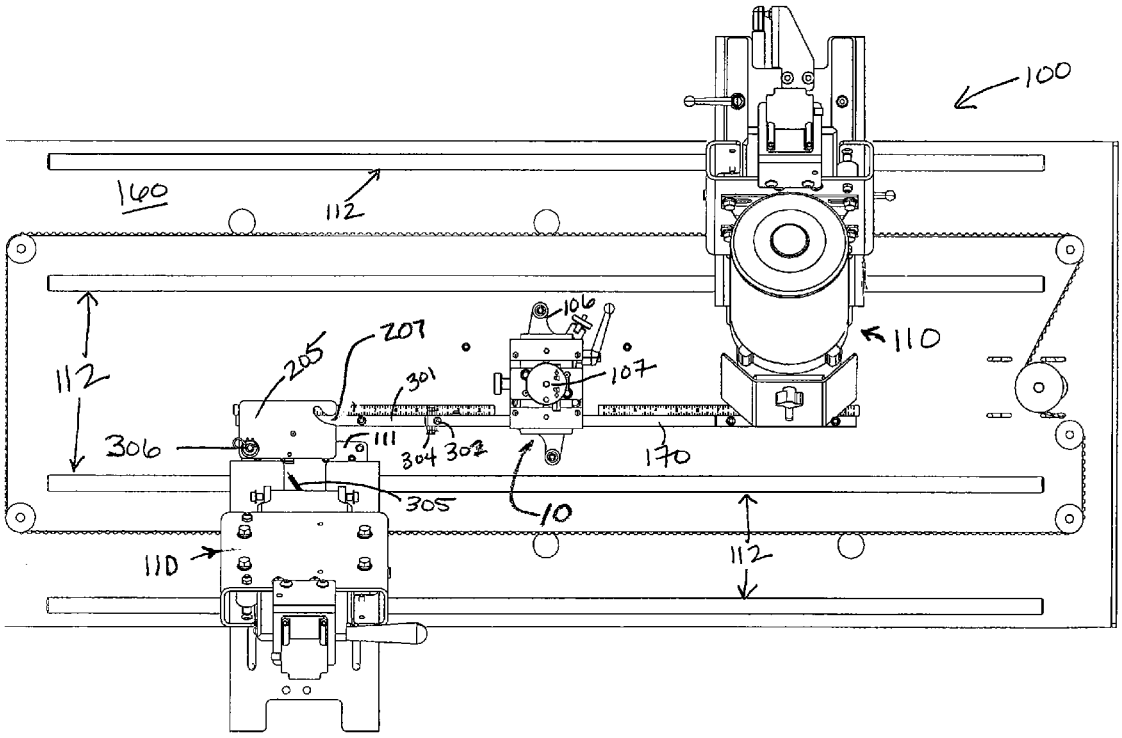
FIGS. 3A and 3B provide a diagram of the apparatus showing, a blade tilting cam system for use in a sharpening apparatus in accordance with the present invention.
Figure 3B:
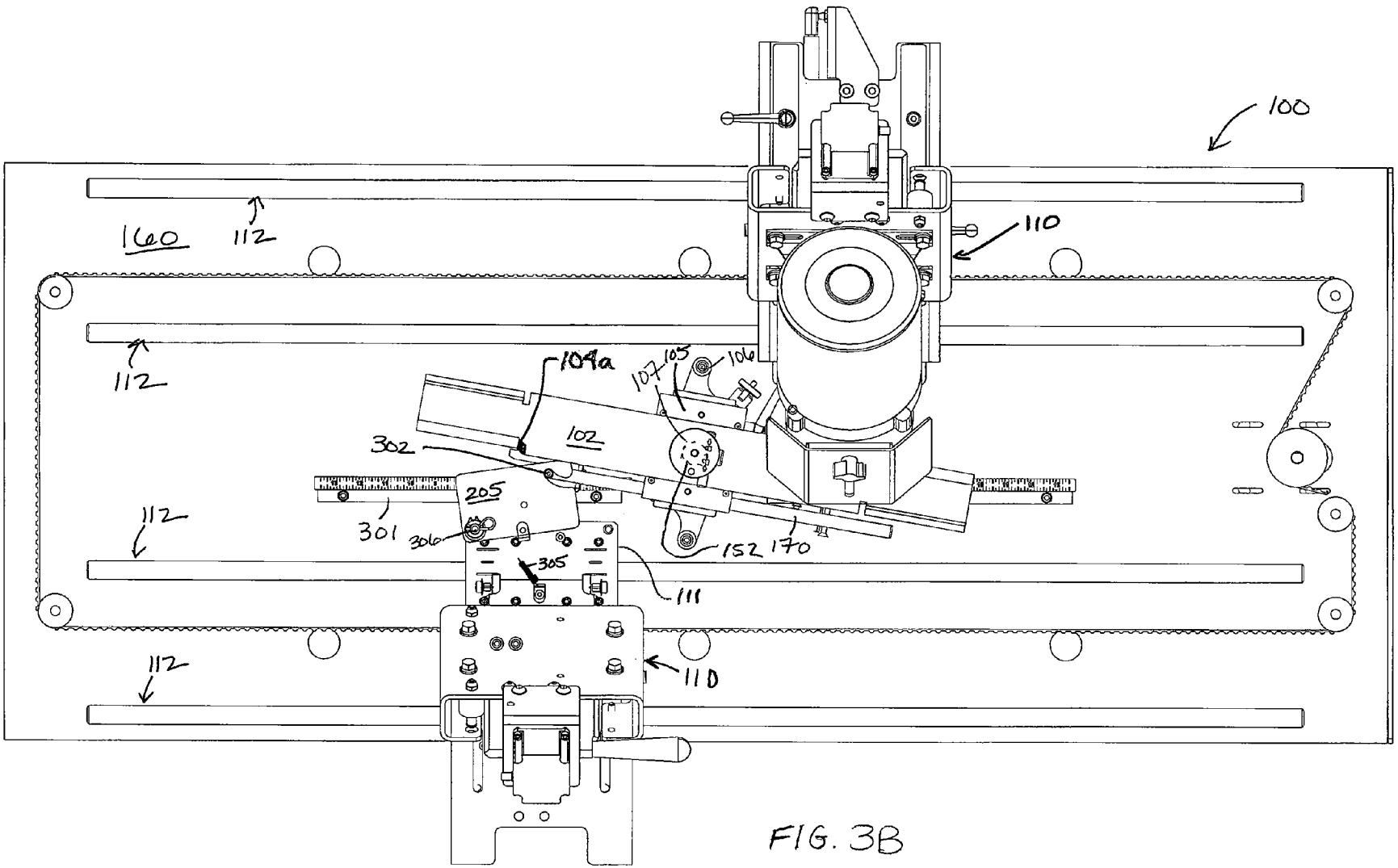
Figure 4:
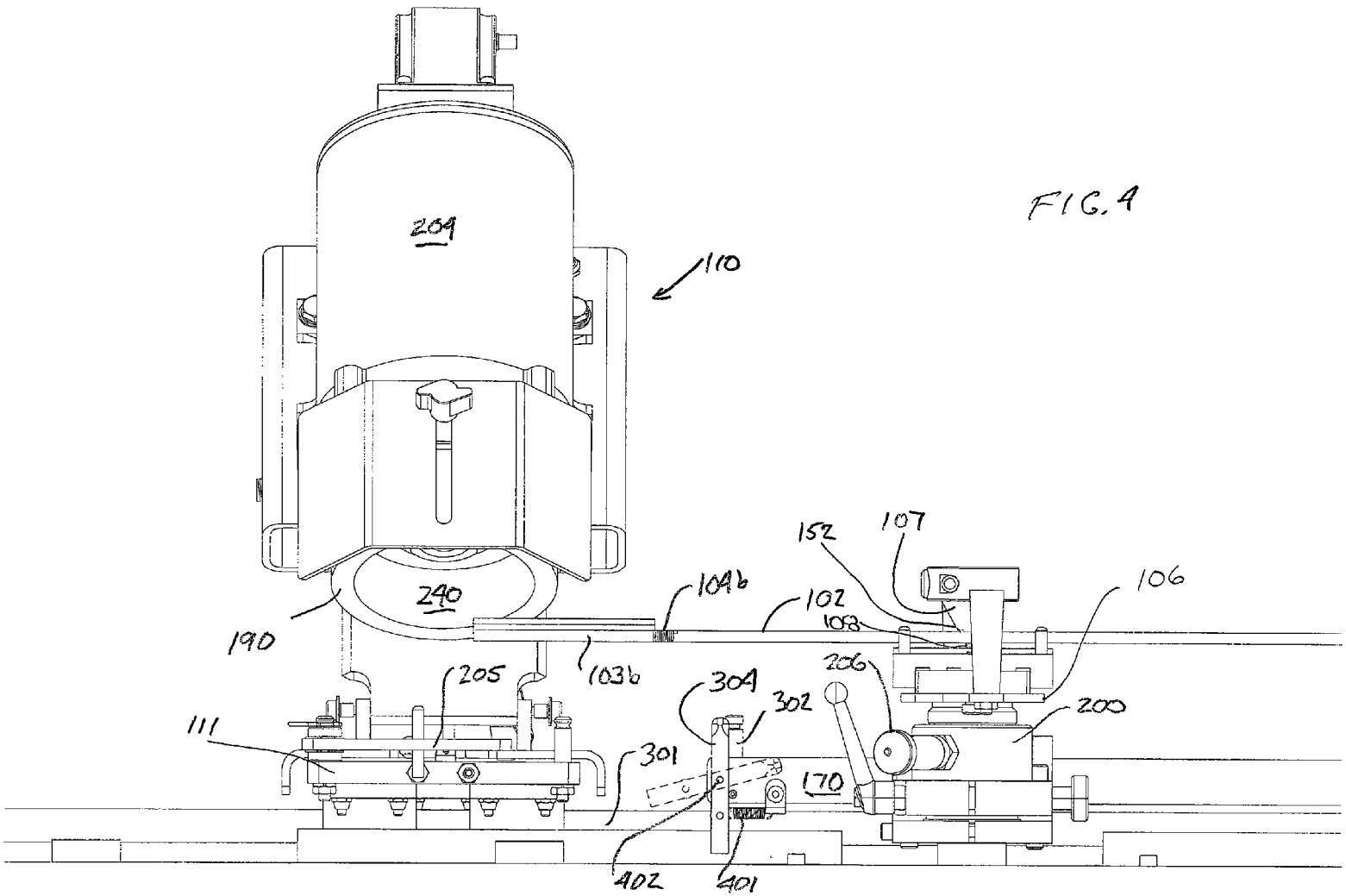
FIG. 4 provides a top view of a release mechanism for use with the cam system as shown in FIGS. 3A and 3B.

FIGS. 3A and 3B illustrate further details of the operation of cam plate 205. In FIGS. 3A and 3B, one of the support carriages 111 is shown without the grinding head assembly 110 and motor 204 in order to provide a view of the underlying cam system using cam plate 205. Blade 102 is also removed from the view in FIG. 3A. As the support carriage 111 (with grinding head assembly 110 and motor 204 attached during actual operation) moves toward the center of the sharpening device by sliding along traverse shafts 112, the cam plate 205 engages, rotates and releases latch/release 304 (shown in greater detail in FIG. 4) that both holds the blade 102 stable for the main, linear grind and, by releasing, enables tilting of the blade 102 and center support assembly 10 (including clamp blocks 105, cam plate 106 and relief rotate bar 170) as shown in FIG. 3B. The cam plate 205 is driven against the upper and lower arms (as seen in FIG. 3B) of latch/release 304, causing it to rotate as shown in FIG. 4 (dotted lines) and release relief rotate bar 170 from anti-rotation bar 301 mounted on main base 160. As the cam plate 205 progresses, its arcuate slot 207 engages a tilt pin 302, which is attached to the relief rotate bar 170. No longer anchored to anti-rotation bar 301 that is attached to the back of the main base 160, the relief rotate bar 170 can pivot, along with the center support assembly 10, on a blade rotation axis X defined by the central axis of the bushings in housing 260 (and of pivot shaft 231) that is aligned with the threaded shaft assembly 108 and center cone 107. As the support carriage 111 continues its movement toward the center of the sharpening device, pin 302 is guided by cam plate 205 as shown in FIG. 3B. The cam plate 205 also rotates on pin 306 once the cam plate 205 engages pin 302. Thus, the cam plate 205 and pin 302 tilt the blade 102 away from the linear grinding path of the grinding head assembly 110 to make a large radius curve at the inner cutting edge 104*a* of the blade 102. After this curve is formed, the support carriage 111 moves back away from the center of the blade 102, the cam plate 205 releases the pin 302 and is pulled back into its original position by return spring 305 (additional springs may also be provided, for example, connected to the shaft 231 by means of a bar 234 (see FIGS. 2, 7) attached at its flattened end 232 and also attached to the main base 160), the blade 102 returns to its original horizontal position, and the latch/release 304 returns to engagement on anti-rotation bar 301 via spring 401 in FIG. 4.

FIG. 4 provides a top view of the sharpening operation shown in FIGS. 3A and 3B, aiding further description of the blade tilting initiated by cam plate 205. In FIG. 4, as the grinding head assembly 110 on support carriage 111 approaches the outer end of the blade 102, the grinding head assembly 110 sharpens the angled cutting edge 103*b* of the blade 102 at a selected sharpening angle (see slot adjustment at 202 in FIG. 2). As cam plate 205 approaches latch/release 304 and pin 302, cam plate 205 pushes the outer ends of the latch/release 304 (which is H-shaped) in a direction toward the center of the blade 102, causing the latch/release 304 to pivot around its pivot pin 402. The latch/release 304 also has a return spring 401 that is placed under tension as the cam plate 205 rotates the latch/release 304. The pin 302 then engages the cam plate 205. Once the cam plate 205 has pushed the latch/release 304 far enough to release the relief rotate bar 170 from the anti-rotation bar 301, the end of the blade 102 approached by cam plate 205 and the blade mounting system pivot, driving that end of the blade 102 in an upward (or clockwise as seen in FIG. 3B) rotational direction as guided by cam plate 205 to form the curved relief portion of the inner end of the cutting edge 103*b* at that end of the blade 102. The same result occurs at the other grinding head assembly, although here the end of the blade 102 moves in opposite or downward direction (as seen in FIG. 3B). Retraction of the cam plate 205 with the grinding head assembly 110 and carriage 111, which occurs after sharpening, results in the release spring 401 rotating the latch/release 304 back into its locked position around anti-rotation bar 301. Cam plate 205 also returns to its original position. Thus, the center support assembly 10 first positions the blade 102 in a fixed state to enable each grinding head assembly 110 to grind a cutting edge in a direction substantially parallel to a longitudinal axis of the blade 102 (or at a selected angle), and the latch/release 304 controls a tilting state to enable the blade 102 to pivot away from the grinding head assemblies 110 while a linear grinding path continues, thereby forming a curve 104*a*, 104*b* at the inner end of each cutting edge.

In an alternative system in accordance with the design, the blade need not be tilted to achieve relief grinding; thus no tilting state is used. Rather, the blade 102 may remain fixed, with a cam or other timed motion control system (not shown, but implemented mechanically and in control software in control system 800 via in/out feed motor controls 822, 826) being provided to retract the grinding head assemblies 10 away from the blade 102 at the end of sharpening the straight portion of cutting edges 103*a* and 103*b*, instead of tilting the blade 102 away from the grinding head assemblies 110. The grinding head assembly motion may, for example, involve retraction along a path defined by the grinding head assembly axis of rotation, to enable forming of the curved portions of edges 104*a*, 104*b* of the blade 102.

Blade Clamping and Central Support Assembly Functions. FIG. 5 provides a rear view of the clamping assembly used to clamp against the sides of the rotary blade 102 to hold the rotary blade 102 during sharpening. The clamping assembly comprises movable blade clamp blocks 105 that may be positioned by turning a cam lever 106 to move support dowels 109 against (counterclockwise motion of lever 106 in FIG. 5) or away from (clockwise motion of lever 106 in FIG. 5) the sides of the rotary blade 102. Rotation of the cam lever 106 around a base of central pin 108 enables pins 503 to slide along cam openings 502 to position the blade clamp blocks 105, thereby accommodating a variety of blade widths. A blade center mount 501 is also provided to support the center of the rotary blade 102.

Figure 6A:
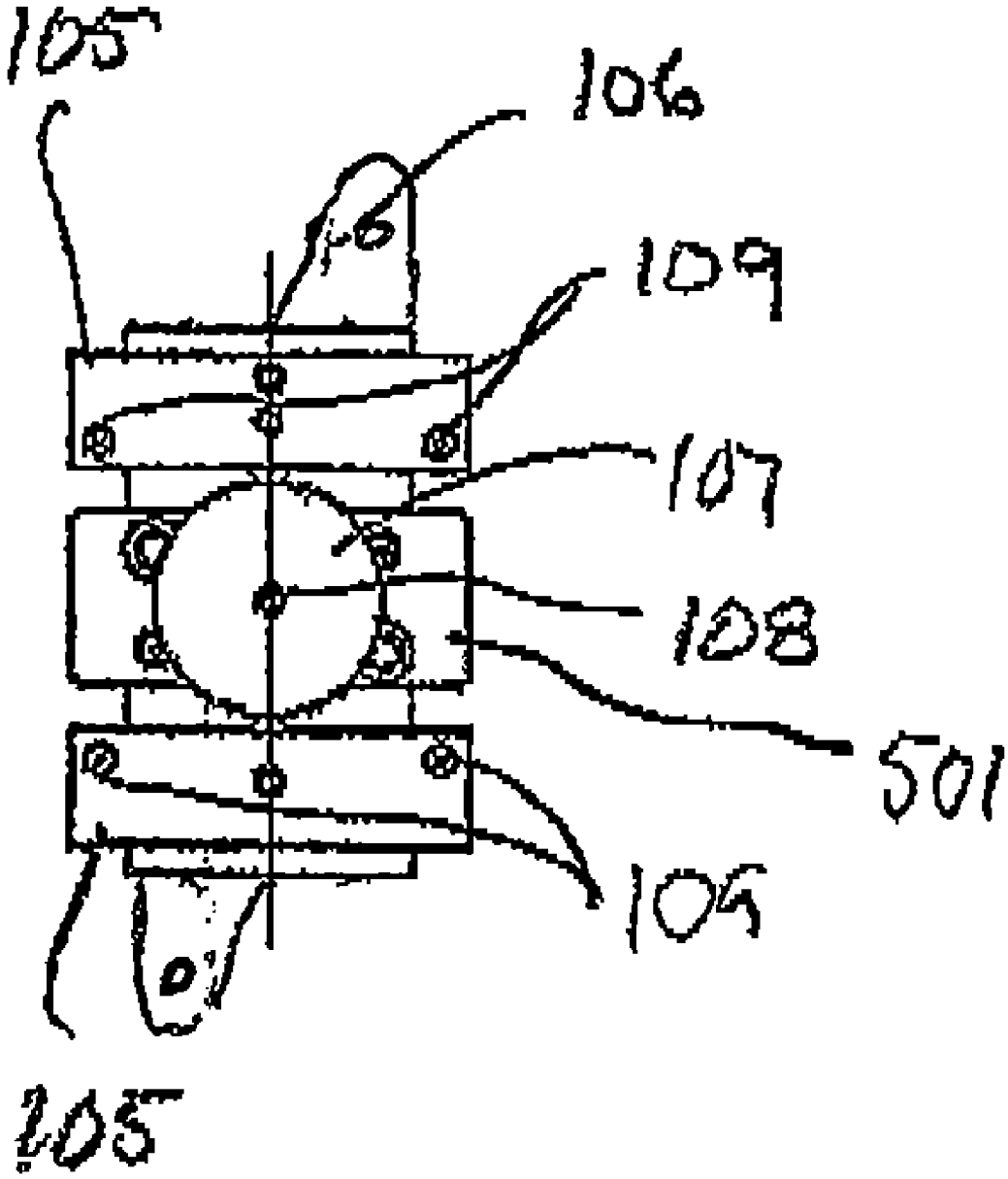
FIGS. 6A and 6B provide a front and a side view of the assembly of FIG. 5 and an associated balancing mechanism.
Figure 6B:
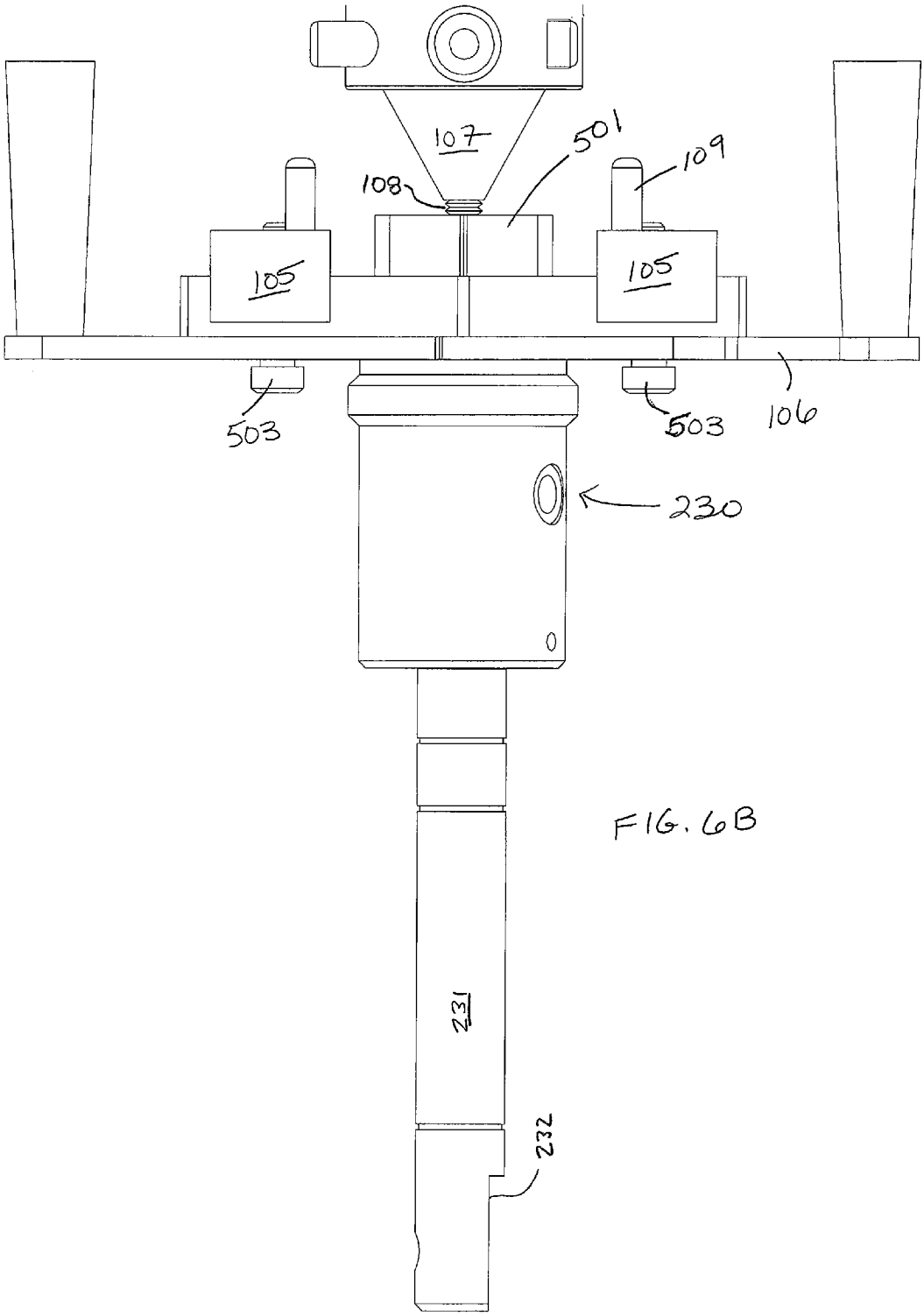

FIGS. 6A and 6B provide a front and a side view of the center support assembly 10, including cam lever 106, clamp blocks 105, and their support dowels 109. FIGS. 6A and 6B also show how blade center mount 501 is provided to support the center of the rotary blade 102 and central threaded post 108, which receives the mounting cone 107. Further, FIG. 6B shows a balancer bearing assembly 230 aligned with the central threaded shaft assembly 108 and extending away from the cam lever 106. This balancer bearing assembly 230 attached to axle 231 supports the rotary blade 102 and the clamping assembly in a free pivoting state during the balancing operation, which is available only after the pin 206 is unlocked. The bearings supporting the front half of the center support assembly 10 in the free pivoting state are sufficiently low friction to reveal any rotational imbalance when the blade 102 is placed in a horizontal position. The imbalance is revealed when the heavier end of the blade 102 pivots downward. For stability during grinding, the pin 206 remains in locked position and the rotary blade 102 is not free to pivot easily, although the controlled tilting operation referred to will occur. Here the entire center support assembly 10 is unlocked to tilt, with the axle 231 pivoting in bushings (not shown) that support it.

Figure 7:
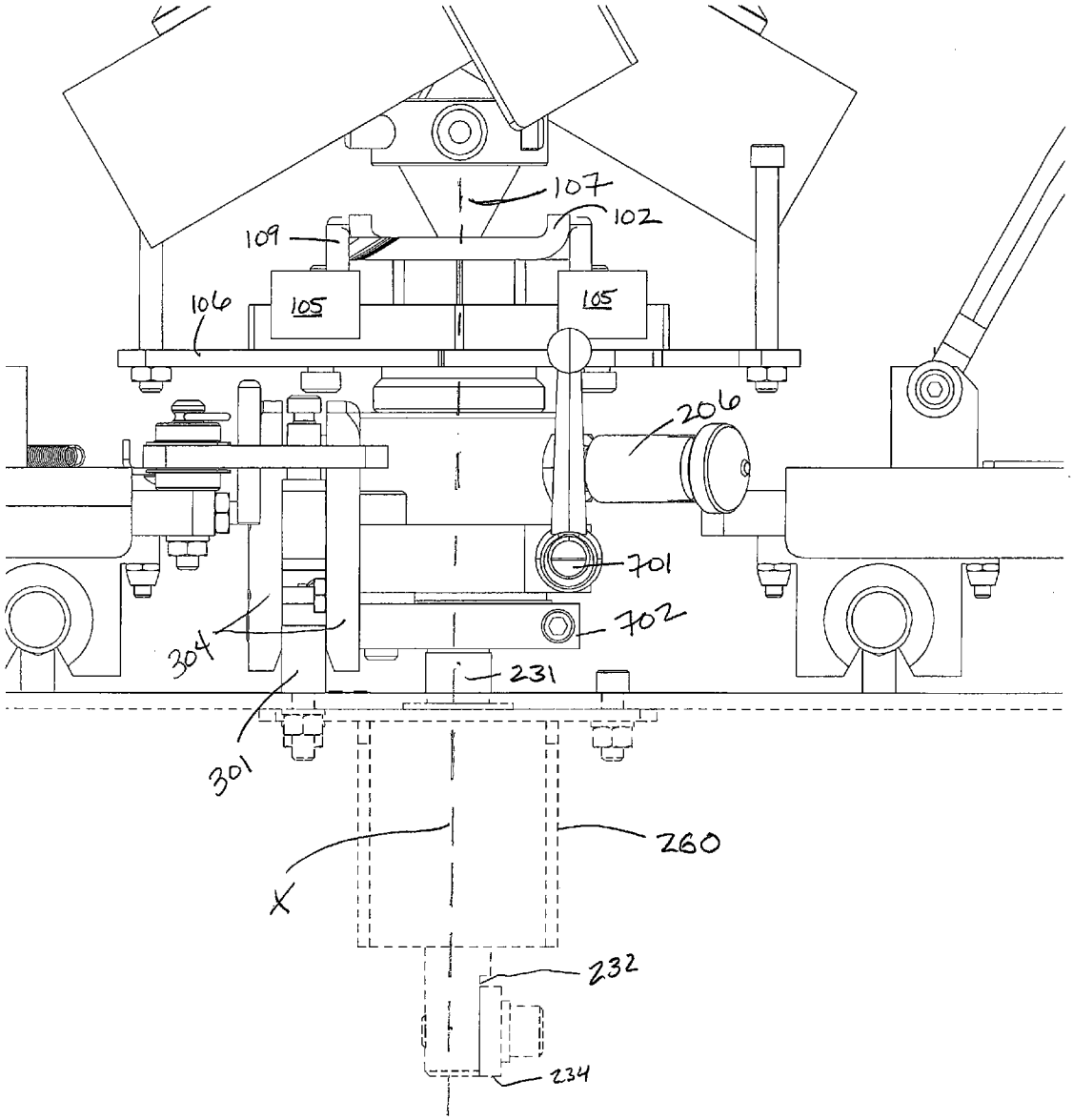
FIG. 7 provides a diagram of a locking mechanism for use with the assembly of FIG. 5 and balancing mechanism of FIGS. 6A-6B.

FIG. 7 provides additional details concerning the center support assembly 10 and balancer lock pin 206. The rotary blade 102 is initially mounted in a fixed position/state at a fixed angle with respect to the grinding path of grinding head assemblies 110. The latch/release 304 locks relief rotate bar 170 to anti-rotate bar 301 for this fixed state.) This angle will be horizontal when the cutting edges 103*a* and 103*b* are parallel to the blade's horizontal axis or at an angle for blades having cutting edges 103*a* and 103*b* that are at an angle relative to that horizontal axis. The angle of rotary blade 102 in the fixed state of the blade in the straight grinding process is determined by adjusting a lock clamp plate 701. The rotary blade 102, as held by blade clamp blocks 105, cam lever 106 and dowels 109, may be rotated around its blade rotation axis X to the desired angle for straight grinding of the cutting edges 103*a* and 103*b* of the rotary blade 102. Once this angle is determined, lock clamp plate 701 is tightened and further movement of the rotary blade 102 around axis X is limited to the tilting motion described above (unless lock pin 206 is released). In the fixed position, lock clamp plate 701 and locking pin 206 are in a locked position. Thus, the rotary blade 102 is not rotatable in any direction in this first fixed position, as long as latch/release 304 is engaged to anti-rotation bar 301. Pivot shaft clamp plate 702 ties the lock clamp plate 701 to pivot shaft 231 and relief rotate bar 170.

During grinding, as the straight grind of cutting edges 103*a* and 103*b* approaches completion and the cam system begins operation as described above with reference to FIGS. 3A and 3B, latch/release 304 that is engaged with anti-rotation bar 301 is released. Relief rotate bar 170 is operably coupled to pivot shaft clamp plate 702. When the latch/release 304 is released from engagement with anti-rotate bar 301, this enables rotation of the center support assembly 10 around axis X to the extent needed to perform sharpening of curved edges 104*a*, 104*b* of the rotary blade 102. Lock clamp plate 701 remains in its locked position. Once the cam system has completed the tilting state and disengaged from latch/release 304, latch/release 304 reengages with anti-rotate bar 301, and is re-locked into position (the first state), such that the rotary blade 102 may not rotate about axis X. In this way, sharpening of edges 103*a*, 103*b* and, if desired, relief curves 104*a*, 104*b* of rotary blade 102 is performed.

After sharpening, a balancing check is performed on the rotary blade 102 to determine whether the blade is balanced or requires further grinding to cause material removal sufficient to achieve balance. As seen in FIG. 7, the locking pin 206 is readily released by pulling it out and locking it out to perform this balancing test. When the locking pin 206 is disengaged for balancing, the rotary blade 102 is free to pivot on balancer bearing assembly 230 (i.e., axis X). To provide true free pivoting, suitable bearings may be used, for example, by supporting the front half of the center support assembly 10 with a minimum drag ball bearing assembly within balancer bearing assembly 230. Balance of the rotary blade 102 is determined by whether the blade remains in a horizontal position when the locking pin 206 is released, or whether the blade rotates away from a horizontal position when released. If the rotary blade 102 remains horizontal, the rotary blade 102 is balanced and grinding is complete. If the rotary blade 102 rotates away from its horizontal position, additional grinding on the heavier end of the blade is required. The rotary blade 102 is repositioned by re-locking the locking pin 206. Once the rotary blade 102 is repositioned, additional grinding on one end of the blade for weight removal may be performed by engaging one of the grinding head assemblies 110 with the blade and retracting the other grinding head assembly 110 away from the blade using infeed/outfeed adjusting mechanism 203 (see FIG. 2). In this way, blade balancing (even including several supplemental grindings of the heavy end) is performed without removing the blade from the sharpening device. Moreover, the locking pin 206 and clamp 701 insure that the blade is repositioned in substantially the same position each time to enable precise and consistent sharpening of the blade.

Alternatives. Alternative clamping, locking or positioning mechanisms may also be used in accordance with the present invention to fix the blade in the fixed state during straight grinding, a controlled tilting state during sharpening of the curved portions 104 of the cutting edges 103*a* and 103*b*, and a freely pivoting state for use in balancing the blade. For example, magnets, clamps, keys, two-position rotating or sliding inserts, and other selectable locking, latching or releasing arrangements may be used to link and unlink the front and back halves of the center support assembly 10 or to provide locking and releasing of the center support assembly 10 for the controlled tilting state.

In an alternative embodiment of the present invention (not shown), a single grinding head assembly and support carriage may be provided (instead of two grinding head assemblies), such that sharpening of a rotary blade 102 is performed in two steps. First, the rotary blade 102 is positioned such that a first cutting edge (e.g., edge 103*a*) is sharpened by the grinding head assembly. Then, the blade is rotated 180 degrees and repositioned with the opposite cutting edge (e.g., 103*b*) in position to be sharpened by the same grinding head assembly. This may be assisted by providing locking pin 206 with two seating positions, separated by 180 degrees. During each grind, the blade is locked down relative to the main base 160 and then tilted for any final radius, strain relief grind in the manner shown above. Balancing of the rotary blade 102 is performed as described above, and any imbalance of the blade is corrected by rotating the blade such that the edge needing additional grinding for weight removal faces the side on which the single grinding head assembly is provided.

From the above description and drawings, it will be understood by those of ordinary skill in the art that the particular embodiments shown and described are for purposes of illustration only and are not intended to limit the scope of the present invention. Those of ordinary skill in the art will recognize that the present invention may be embodied in other specific forms without departing from its spirit or essential characteristics. References to details of particular embodiments are not intended to limit the scope of the invention.

What is claimed:

1. A device for sharpening a rotary mower blade with a rotational axis at its center, a longitudinal axis and a pair of cutting edges, one cutting edge on each of opposed sides of the longitudinal axis, comprising:

a blade mounting assembly for supporting a blade to be sharpened for pivoting about the blade's rotational axis, said mounting assembly being held in a fixed state relative to a main base during sharpening;

at least one grinder wheel having an axis of rotation and a grinding surface oriented perpendicular to the grinder wheel's axis of rotation;

a grinder wheel carriage operably connected to the at least one grinder wheel and mounted to the main base to provide the grinder wheel linear motion along a grinding path generally parallel to and in grinding engagement with a cutting edge of the blade;

means for moving the carriage and grinder wheel along the grinding path; and a lock for selectively holding and releasing the blade mounting assembly from its fixed state into a freely pivoting state sufficient to reveal rotational imbalance in the blade.

2. The device of claim 1, wherein each cutting edge has a distal end and an inner end nearer its center, further comprising means for causing relative motion between the blade and the grinding surface as the grinding surface reaches the inner end of the cutting edge to form a radius there.

3. The device of claim 2, wherein the means for causing relative motion between the blade and the grinding surface comprises means for releasing the blade mounting assembly from its fixed state to a controlled tilting state and means for causing the blade to tilt in a direction away from the grinding surface as the grinding surface reaches the inner end of the cutting edge.

4. The device of claim 3 wherein the means for causing the blade to tilt in a direction away from the grinding surface as the grinding surface reaches the inner end of the cutting edge comprises a cam actuated by travel of the at least one grinder wheel carriage in a direction generally toward the center of the blade.

5. The device of claim 2, wherein the means for causing relative motion between the blade and the grinding surface comprises means for retracting the grinding surface in a direction away from the cutting edge as the grinding surface reaches the inner end of the cutting edge.

6. The device of claim 1, wherein each grinder wheel carriage further comprises means for selectively adjusting the angle at which the grinding surface achieves grinding engagement with each cutting edge.

7. The device of claim 1 wherein the at least one grinder wheel comprises two grinder wheels, each mounted on a carriage for linear motion along a grinding path, the respective grinding paths being opposed and substantially symmetrical relative to the blade center.

8. The device of claim 1, wherein the blade mounting assembly comprises an opposed pair of clamping blocks for engaging opposed sides of the blade to be sharpened.

9. The device of claim 8, wherein the clamping blocks are controlled for symmetrical clamping motion by a cam plate, opposed ends of which drive the clamping blocks toward and away from each other.

10. The device of claim 1, wherein the freely pivoting state permits the longitudinal axis of the blade to be substantially horizontal.

11. A device for sharpening a mower blade, comprising:

a mounting assembly for mounting a blade having a rotational axis at its center and a pair of cutting edges, one cutting edge on each of opposed sides of the longitudinal axis, wherein the mounting assembly holds the blade in a fixed state or in free pivoting state allowing pivoting from the horizontal that reveals blade rotational imbalance;

at least one grinding head assembly positionable adjacent one end of the blade and in engagement with a cutting edge to be sharpened; and a control system for controlling movement of the at least one grinding head assembly along the cutting edge, wherein the mounting assembly selectively holds the blade in the fixed state to enable the at least one grinding head assembly to grind a cutting edge in a direction substantially parallel to the at least one cutting edge of the blade, and in the free pivoting state to enable the blade to pivot around its rotational axis for balance testing.

12. The device of claim 11, wherein each cutting edge has a distal end and an inner end nearer its center and further comprising means for pivoting the blade away from the at least one grinding head assembly when a linear grind approaches the inner end of a cutting edge, thereby forming a curve at the inner end of such cutting edge.

13. The device according to claim 11, wherein the mounting assembly comprises a locking means for selectively holding the blade in the fixed state or in the free pivoting state when the locking means is released.

14. The device according to claim 13, wherein the mounting assembly is configured with a latch/release to release selectively the blade into a controlled tilting state.

15. The device according to claim 14, wherein the mounting assembly comprises a latch/release that is engaged when the blade is held in the fixed state and provides a controlled tilting state when the latch/release is released.

16. The device according to claim 11, wherein the at least one grinding head assembly comprises a first and a second grinding head assembly and the control system comprises a drive control for symmetrically moving the first and a second grinding head assemblies to substantially simultaneously grind two opposed cutting edges of the blade.

17. The device according to claim 16, wherein the drive control means comprises a controller for a belt drive coupled to the grinding head assemblies, each comprising a carriage, and a drive wheel coupled to the belt drive for providing movement to the grinding head assemblies.

18. A method for sharpening a rotary mower blade, comprising the steps of:

using a mounting assembly, mounting a blade having two cutting edges to be sharpened on opposite sides of the blade's longitudinal axis, wherein the mounting assembly is configured to position the blade in a fixed state and a freely pivoting state; and controlling coordinated movement of two grinding head assemblies, each grinding head assembly being positioned adjacent an opposite end of the blade, wherein each grinding head assembly respectively grinds one of the two opposed cutting edges to be sharpened; and using the mounting assembly, first positioning the blade in the fixed state to enable each grinding head assembly to grind a cutting edge in a direction substantially parallel to the cutting edges of the blade, then positioning the blade substantially horizontally in the freely pivoting state to test the blade for rotational imbalance.

19. The method according to claim 18, wherein the step of using the mounting assembly comprises using a first lock for holding the blade in the fixed state and to release the blade into the free pivoting state when the first lock is released.

20. The method according to claim 18, further comprising using the mounting assembly, positioning the blade in a controlled tilting state, to pivot around its blade rotation axis away from the grinding head assemblies when a linear grind reaches an inner end of the cutting edge, thereby forming a curve at the inner end of each cutting edge.

21. The method according to claim 20, wherein the grinding head assemblies are mounted on a main base and the step of using the mounting assembly to position the blade in a controlled tilting state comprises selectively applying a latch/release that selectively fixes the mounting assembly to the main base and selectively releases the mounting assembly for controlled tilting.

22. The method according to claim 18, further comprising, in response to a rotational imbalance, placing the blade again in the fixed state and controlling the movement of one grinding head assembly to grind a cutting edge associated with a heavier end of the blade.

23. The method according to claim 18, wherein the step of controlling coordinated movement of the two grinding head assemblies is performed using a drive means for symmetrically moving the grinding head assemblies to substantially simultaneously grind the two cutting edges of the blade.

24. The method according to claim 18, wherein the step of first positioning the blade in the fixed state to enable each grinding head assembly to grind a cutting edge in a direction substantially parallel to the cutting edges of the blade, then positioning the blade substantially horizontally in the freely pivoting state to test the blade for rotational imbalance is performed without removing the blade from the mounting assembly.

* * * * *

UNITED STATES PATENT AND TRADEMARK OFFICE

CERTIFICATE OF CORRECTION

PATENT NO. : 7,329,172 B2
APPLICATION NO. : 11/671935
DATED : February 12, 2008
INVENTOR(S) : James H. Dieck and Gregory A. Veenendall It is certified that error appears in the above-identified patent and that said Letters Patent is hereby corrected as shown below:

In Section 54 of the Title Sheet, Page 1, the title of the patent
Reads "ROTARY MOWER BLADE SHARPENER HAVING MOVABLE GRIDING WHEELS"
Should Read -- ROTARY MOWER BLADE SHARPENER HAVING MOVABLE GRINDING WHEELS --

In Section 56 of the Title Sheet, Pages 1 and 2, References Cited, OTHER PUBLICATIONS, the following publications should be added:

-- "The Key to the Manicured Look – Model 600 Spin/Relief Grinder" brochure, Foley United, undated. --
-- "For a Safer Grind" brochure, Foley United, undated. --
-- "The Peerless 2000 Automatic Spin and Relief Grinder" brochure, Simplex Ideal Peerless, undated. --
-- "Landpride Turf Reel Grinders" brochure, Landpride Turf, undated. --
-- "Express Dual" brochure, Bernhard & Company Ltd., undated. --
-- "The Peerless 1360 Automatic Spin and Relief Grinder brochure, Spin and Relief Grinder brochure, Simplex Ideal Peerless, undated. --
-- "Neary Technology, Model 550SR Reel Grinder", brochure, undated. --

Signed and Sealed this

Twenty-sixth Day of August, 2008

JON W. DUDAS
*Director of the United States Patent and Trademark Office*

UNITED STATES PATENT AND TRADEMARK OFFICE

CERTIFICATE OF CORRECTION

PATENT NO. : 7,329,172 B2 
APPLICATION NO. : 11/671935
DATED : February 12, 2008
INVENTOR(S) : James H. Dieck and Gregory A. Veenendall It is certified that error appears in the above-identified patent and that said Letters Patent is hereby corrected as shown below:

In Section 54 of the Title Sheet, Page 1, and Column 1, lines 1 and 2, the title of the patent
Reads "ROTARY MOWER BLADE SHARPENER HAVING MOVABLE GRIDING WHEELS"
Should Read -- ROTARY MOWER BLADE SHARPENER HAVING MOVABLE GRINDING WHEELS --

In Section 56 of the Title Sheet, Pages 1 and 2, References Cited, OTHER PUBLICATIONS, the following publications should be added:

-- "The Key to the Manicured Look – Model 600 Spin/Relief Grinder" brochure, Foley United, undated. --
-- "For a Safer Grind" brochure, Foley United, undated. --
-- "The Peerless 2000 Automatic Spin and Relief Grinder" brochure, Simplex Ideal Peerless, undated. --
-- "Landpride Turf Reel Grinders" brochure, Landpride Turf, undated. --
-- "Express Dual" brochure, Bernhard & Company Ltd., undated. --
-- "The Peerless 1360 Automatic Spin and Relief Grinder brochure, Spin and Relief Grinder brochure, Simplex Ideal Peerless, undated. --
-- "Neary Technology, Model 550SR Reel Grinder", brochure, undated. --

This certificate supersedes the Certificate of Correction issued August 26, 2008.

Signed and Sealed this

Twenty-third Day of September, 2008

JON W. DUDAS
*Director of the United States Patent and Trademark Office*